US006595190B1

(12) United States Patent
Sealy et al.

(10) Patent No.: US 6,595,190 B1
(45) Date of Patent: Jul. 22, 2003

(54) SYSTEM AND METHOD FOR CONTROLLING RELEASE OF FUEL VAPOR FROM A VAPOR RECOVERY SYSTEM

(75) Inventors: Brent Edward Sealy, Dearborn, MI (US); Douglas Joseph Mancini, Farmington, MI (US); Jeffrey Allen Doering, Canton, MI (US); Marianne Lambert Vykydal, Onsted, MI (US); Thomas Raymond Culbertson, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 102 days.

(21) Appl. No.: 09/918,080

(22) Filed: Jul. 30, 2001

(51) Int. Cl.[7] ..... F02M 33/02
(52) U.S. Cl. ..... 123/520; 123/518
(58) Field of Search ..... 123/520, 519, 123/518, 516; 60/283, 285

(56) References Cited

U.S. PATENT DOCUMENTS 5,048,492 A 9/1991 Davenport et al.
5,216,997 A * 6/1993 Osanai et al. ..... 123/698
5,323,751 A * 6/1994 Osanai et al. ..... 123/520
5,746,187 A 5/1998 Ninomiya et al.
5,765,541 A 6/1998 Farmer et al.
5,778,859 A 7/1998 Takagi
5,988,151 A 11/1999 Schneider
6,041,761 A 3/2000 Uto et al.
6,047,688 A 4/2000 Duty et al.
6,079,393 A * 6/2000 Tsutsumi et al. ..... 123/478
6,089,210 A 7/2000 Kadowaki

FOREIGN PATENT DOCUMENTS

JP 7332172 * 12/1995
JP 11132115 * 5/1999

* cited by examiner

*Primary Examiner*—Mahmoud Gimie
(74) *Attorney, Agent, or Firm*—John F. Buckert; Allan J. Lippa

(57) ABSTRACT

A system and method for adjusting fuel vapor delivery from a fuel vapor recovery system in an internal combustion engine. A requested amount of fuel vapor delivery is determined based upon a desired fuel vapor delivery amount and various system constraints, which ensure continued optimal operation of the vehicle. Purge fuel ratios are calculated by comparing desired levels to actual levels of various operating parameters. The purge fuel ratios are compared to each other to determine the minimum value from among the various purge fuel ratios, which is indicative of the most limiting system constraint. The most limiting system constraint is used to calculate an amount of fuel vapor to be delivered from the vapor recovery system.

36 Claims, 5 Drawing Sheets

SYSTEM AND METHOD FOR CONTROLLING RELEASE OF FUEL VAPOR FROM A VAPOR RECOVERY SYSTEM

FIELD OF THE INVENTION

The present invention relates generally to a system and method for controlling a fuel vapor recovery system in an internal combustion engine.

BACKGROUND OF THE INVENTION

Motor vehicles of recent years typically incorporate a fuel vapor recovery system in connection with the internal combustion engine to reduce the amount of fuel vapors released into the atmosphere from the fuel tank. Typically, a canister containing a fuel vapor absorbing material, such as activated charcoal, is coupled between the fuel tank and the air/fuel intake of the engine. A purge valve positioned between the canister and air/fuel intake of the engine facilitates the periodic purging of fuel vapors from the canister. The fuel vapor absorbing material absorbs fuel vapor from the fuel tank. The purged fuel vapors are channeled into the air/fuel intake of the engine.

Generally, it is desirable to maximize the amount of fuel vapor purged from the canister over a given period of time to continuously maintain adequate storage capacity of the canister. However, the addition of fuel vapor to the air/fuel intake increases the amount of fuel supplied to the engine cylinders, thereby altering the engine air/fuel ratio. The desired engine air/fuel ratio is carefully determined to ensure favorable drivability characteristics and to control undesirable engine emissions. To avoid altering the desired air/fuel ratio, and thus avoid undesirable engine emissions and adverse vehicle drivability (such as transient torque fluctuations), the amount of fuel vapor added to the air/fuel intake should be controlled so that certain engine operating parameters are satisfied.

Known systems and methods for purging the vapor recovery system attempt to achieve the above-described objectives by gradually opening the purge valve over a period of time. As the purge valve is slowly opened, an electronic engine controller determines, or "learns", the amount of fuel vapor that flows through the purge valve and into the engine air/fuel intake. The controller also observes various engine operating parameters, such as engine air mass, fuel injector pulse width, and fuel tank sloshing conditions, to determine if the level of fuel contribution currently provided from the vapor recovery is likely to cause transient torque fluctuations or otherwise degrade vehicle drivability. Such operating parameters are interchangeably referred to herein as "system constraints." If all of the operating parameters, or system constraints, are within acceptable ranges, the purge valve continues to be gradually opened. On the other hand, if one or more of the operating parameters falls out of acceptable range, the purge valve is completely closed, and the process of gradually opening the purge valve begins again.

The inventors herein have recognized that when utilizing the known method, the purge valve is repeatedly closed during engine operation due to one of the engine operating parameters falling out of an acceptable range. Further, the inventors have recognized that the greatest amount of uncertainty concerning the amount of fuel vapor being purged occurs during the initial opening of the purge valve. Thus, because the purge valve is being repeatedly closed, the calculated fuel vapor amount being supplied from the vapor recovery system may have a relatively large error whenever the purge valve is reopened. Thus, a total calculated fueling amount representing the sum of the desired fuel amount from the fuel injectors and the calculated fuel vapor amount may also have an error immediately after the purge valve is reopened. The error in the total calculated fuel amount may result in undesirable transient torque fluctuations, decreased fuel economy, and degraded emission control.

SUMMARY OF THE INVENTION

A new system and method is provided for controlling the amount of fuel vapors delivered to the engine cylinders from the fuel vapor recovery system. In connection therewith, a new system and method is provided for evaluating various engine operating parameters that are indicative of vehicle drivability characteristics and for determining which of the parameters is the most limiting constraint on the fuel vapor recovery system. More specifically, the current values of various operating parameters are each compared to a respective maximum value or reference value to determine a unique "purge flow ratio" associated with each operating parameter. Each purge flow ratio is indicative of the difference between the current value of the operating parameter and either the desired value or maximum value for that same operating parameter. The engine operating parameter associated with the minimum purge flow ratio is considered to be the overall most limiting system constraint. Thus, the purge flow of the vapor recovery system is adjusted based on the minimum purge flow ratio.

If the minimum purge flow ratio is greater than a reference value, preferably 1.0, then the purge flow from the vapor recovery system can be safely increased. The minimum purge flow ratio may be used to determine an appropriate amount to increase the purge flow. On the other hand, if the minimum purge flow ratio is less than the reference value, then the purge flow from the vapor recovery system should be decreased. Instead of completely closing the purge valve, as in the prior art, the purge valve is only partially closed, the degree to which may be determined based on the value of the minimum purge flow ratio.

DETAILED DESCRIPTION OF A PREFERRED EMBODIMENT

Figure 1:
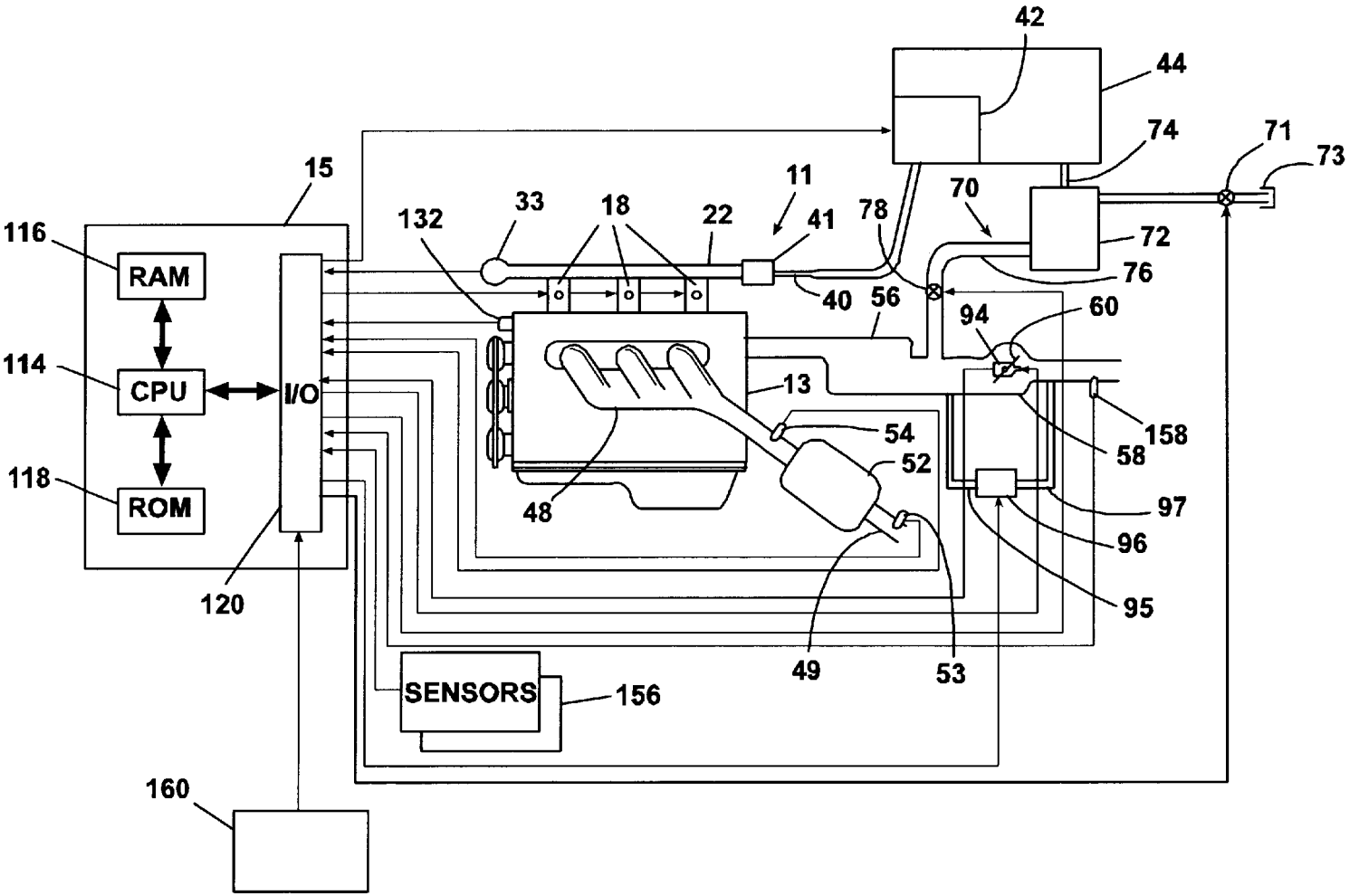
FIG. 1 is a schematic of an internal combustion engine according to a preferred embodiment of the invention.

FIG. 1 illustrates an exemplary internal combustion engine according to a preferred embodiment of the invention. Fuel delivery system 11 of a conventional automotive internal combustion engine 13 is controlled by controller 15, such as an EEC or PCM. Engine 13 comprises fuel injectors 18, which are in fluid communication with fuel rail 22 to inject fuel into the cylinders (not shown) of engine 13, and temperature sensor 132 for sensing temperature of engine 13. Fuel delivery system 11 has fuel rail 22, fuel rail pressure sensor 33 connected to fuel rail 22, fuel line 40 coupled to fuel rail 22 via coupling 41, fuel pump 42, which is housed within fuel tank 44, to selectively deliver fuel to fuel rail 22 via fuel line 40.

Controller 15 has CPU 114, random access memory 116 (RAM), computer storage medium 118 (ROM), having a computer readable code encoded therein, which is an electronically programmable chip in this example, and input/output (I/O) bus 120. Controller 15 controls engine 13 by receiving various inputs through I/O bus 120, such as fuel pressure in fuel delivery system 11, as sensed by pressure sensor 33; relative exhaust air/fuel ratio as sensed by exhaust gas sensor 54 and exhaust gas sensor 53; temperature of engine 13 as sensed by temperature sensor 132; measurement of inducted mass airflow (MAF) from mass airflow sensor 158; speed of engine (RPM) from engine speed sensor 160; and various other sensors 156. Controller 15 also creates various outputs through I/O bus 120 to actuate the various components of the engine control system. Such components include fuel injectors 18, fuel delivery system 42, and vapor purge control valve 78.

Fuel pump 42, upon demand from engine 13 and under control of controller 15, pumps fuel from fuel tank 44 through fuel line 40, and into pressure fuel rail 22 for distribution to the fuel injectors 18 during conventional operation. Controller 15 controls fuel injectors 18 to maintain a desired air/fuel (A/F) ratio.

Engine 13 also comprises exhaust manifold 48 coupled to exhaust ports of the engine (not shown). Catalytic converter 52 is coupled to exhaust manifold 48. A first exhaust gas sensor 54 is positioned upstream of catalytic converter 52 in exhaust manifold 48. A second exhaust gas sensor 53 is positioned downstream of catalytic converter 52 in tail pipe 49. Exhaust gas sensors 53 and 54 may comprise any one of a plurality of conventional exhaust gas sensors. For example, sensors 53 and 54 may generate a two-state signal corresponding to engine operation lean or rich of stoichometry. In another embodiment, sensors 53 and 54 provide a signal related to an engine air/fuel ratio in exhaust gases. Those skilled in the art will recognize that other forms of exhaust gas sensors may be used to advantage.

Engine 13 also comprises intake manifold 56 coupled to throttle body 58 having throttle plate 60 therein. Throttle plate 60 is coupled to electric motor 94 so that the position of throttle plate 60 is controlled by controller 15 via electric motor 94. This configuration is commonly referred to as electronic throttle control (ETC), which is also utilized during idle speed control. Idle bypass passageway 97 is coupled between throttle body 58 and intake manifold 56 via solenoid valve 96. Controller 15 provides pulse width modulated signal ISDC to solenoid valve 96 so that air flow is inducted into engine 13 at a rate proportional to the duty cycle of signal ISDC.

Intake manifold 56 is also coupled to vapor recovery system 70. Vapor recovery system 70 comprises charcoal canister 72 coupled to fuel tank 44 via fuel tank connection line 74. Vapor recovery system 70 also comprises vapor purge control valve 78 positioned in intake vapor line 76 between intake manifold 56 and charcoal canister 72, which is controlled by electronic signals from controller 15. Ambient air inlet vent 73 is connected to charcoal canister 72 and air passing therethrough is controlled by inlet valve 71 in response to control signals from controller 15.

During fuel vapor purge, air is drawn through canister 72 via inlet vent 73 absorbing hydrocarbons from the activated charcoal. The mixture of purged air and absorbed vapors is then inducted into intake manifold 56 via purge control valve 78, which is controlled by signals provided by controller 15. Concurrently, fuel vapors from fuel tank 44 are drawn into intake manifold 56 via purge control valve 78.

A first aspect of the invented system and method relates to regulating purge flow through the purge control valve 78 to maximize the amount of purge flow (to effectively "clean out" the canister 72) within certain limits to satisfy various engine operating parameters, or constraints. For example, it is desirable to maintain the purge flow at a level so that the engine air/fuel ratio does not stray outside of an efficient conversion window of the catalytic converter 52. Similarly, it is desirable to limit the purge flow so that the amount of air passing through the vapor recovery system does not degrade idle airflow controllability. It is also desirable to limit the amount of fuel vapor passing through the vapor recovery system so that it does not degrade fuel injector controllability due to requiring extremely small pulse widths from the controller 15 and so that it does not degrade engine combustion stability due to maldistribution. Finally, it is desirable to limit the purge flow so as to avoid engine stalls due to purge-related air/fuel ratio control problems. To maximize purge flow while satisfying the above-identified operating parameters, or system constraints, a preferred embodiment of the invention employs a new method and system to determine a unitless reference value (PG_FLOW_MUL) that can be used to adjust the purge flow so as to maximize the purge flow within the stated constraints. That is, the PG_FLOW_MUL value takes into consideration all of the identified constraints, and, based on the PG_FLOW_MUL value, the system determines whether the purge flow should be adjusted upward or downward in light of the given targets and constraints. Further, one skilled in the art, in view of this disclosure, will understand that the disclosed system and method can be modified to take into account other constraints than those identified herein.

Figure 2:
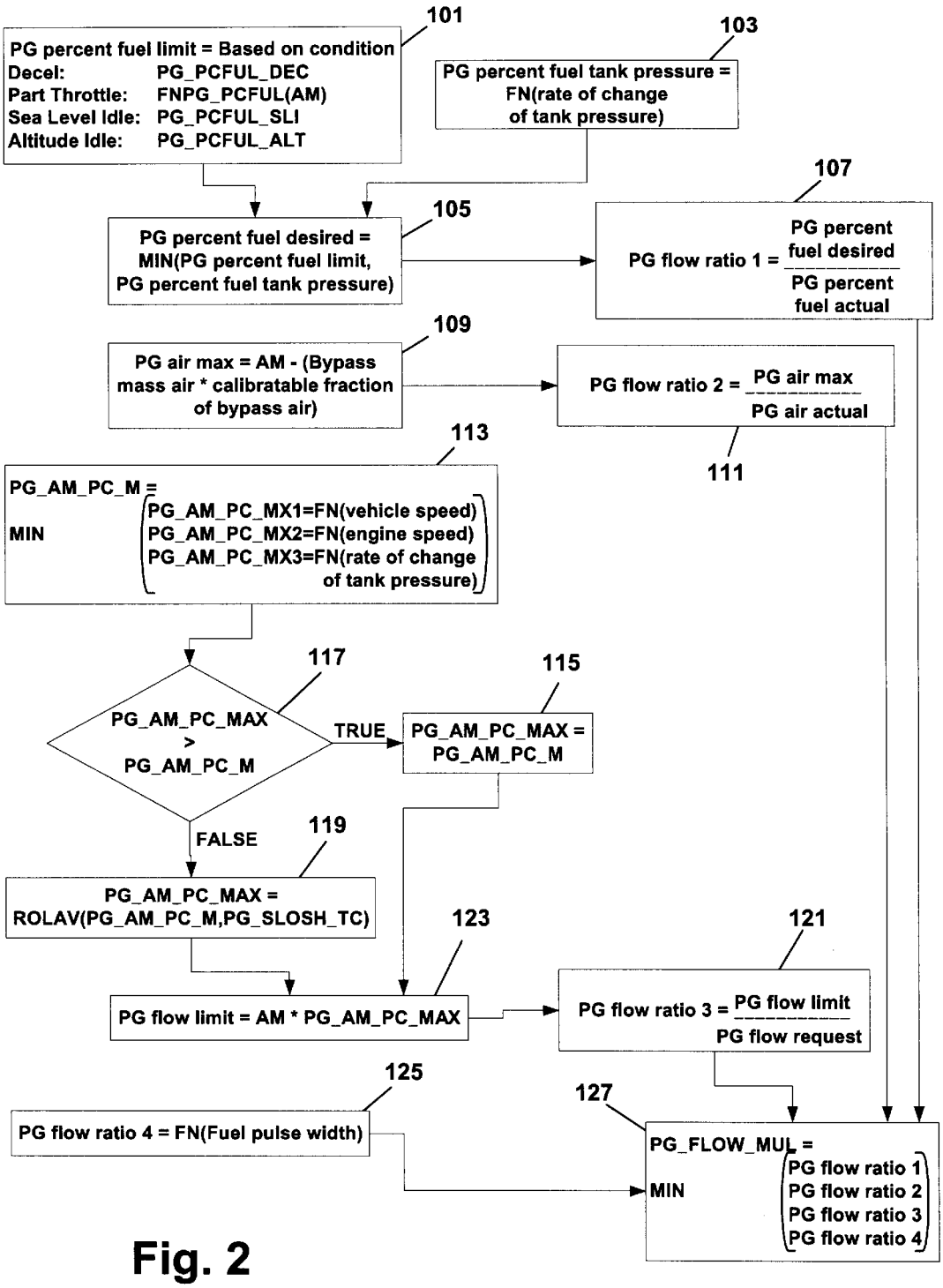
FIG. 2 is a flow chart illustrating a first aspect of a preferred embodiment of the invention relating to determining a unitless purge system adjustment value.

FIG. 2 sets forth a flow diagram that schematically illustrates a preferred embodiment of this first aspect of the invention. In general, the invented system calculates unitless values (PG Flow Ratios) for the target purge flow and each of the system constraints. In the case of the desired purge flow, the PG Flow Ratio is calculated by dividing the desired purge flow by an estimate of the actual purge flow. Similarly, in the case of the system constraints, the respective PG Flow Ratios are calculated by dividing a maximum value for each operating parameter by an actual value (estimated or measured) for the same operating parameter. For a given operating parameter, if the corresponding PG Flow Ratio is greater than 1.0, the purge flow could be increased without violating that constraint. On the other hand, if the corresponding PG Flow Ratio is less than 1.0, the constraint is currently being violated, and the purge flow should be reduced to accommodate the constraint. Thus, the minimum of the PG Flow Ratios relating to the desired purge flow and each of the system constraints is the overall limiting factor in the system. In other words, to adjust the system purge as close to the desired purge flow as possible without violating any of the system constraints, the system purge flow should be adjusted upward or downward based on the minimum value from among the various Purge Flow Ratios. Thus, the minimum of the various Purge Flow Ratios is the unitless PG_FLOW_MUL value that is used to adjust the purge flow upward or downward, as described below.

Describing FIG. 2 in more detail, the goal of the steps set forth in block 101 through 107 is to calculate a unitless PG Flow Ratio value corresponding to the desired percent of engine fuel flow coming from the purge system. The desired PG percent fuel is that level of purge flow that would be desirable without consideration of any of the system constraints. The desired PG percent fuel is determined based on various operating parameters. Specifically, first a PG Percent Fuel Limit value, which represents the desired purge flow, is determined in block 101 based on which of four mutually-exclusive operating conditions is occurring: (i) deceleration; (ii) partial throttle; (iii) sea level idle; and (iv) high altitude idle. According to a preferred embodiment of the invention, if the vehicle is being operated in any of modes (i), (iii), or (iv), the PG Percent Fuel Limit value is assigned to a corresponding particular calibrated value (signified, respectively, by the variables PG_PCFUL_DEC, PG_PCFUL_SLI, PG_PCFUL_ALT in block 101). If the vehicle is being operated in mode (ii), the PG Percent Fuel Limit value is assigned a calibrated value that is retrieved from a one-dimensional look-up table dependant on the measured engine air mass flow rate (signified by FNPG_PCFUL(AM)). In this way, the invented system recognizes that the desired purge flow varies with the engine load, the level of which is implied from the "engine air mass flow rate" (AM).

The desired purge flow determined in block 101 is limited, though, during periods of fuel tank sloshing conditions. The sloshing condition is a system constraint that limits the target purge flow. At block 103, a sloshing condition limitation (PG Percent Fuel Tank Pressure) on the desired purge flow is determined from a one-dimensional look-up table based on the rate of change of fuel tank pressure. The greater the change in fuel tank pressure, the lower the PG Percent Fuel Tank Pressure value, which imposes a greater limitation on the desired purge flow.

At block 105, the final desired purge flow, which is the desired purge flow after considering the sloshing condition operational constraint, is determined by taking the minimum of the desired purge flow (PG Percent Fuel Limit) and the sloshing condition limitation (PG Percent Fuel Tank Pressure). This minimum value is the desired purge flow (PG Percent Fuel Desired). In other words, the PG Percent Fuel Desired is set to the lesser of the PG Percent Fuel Limit and the PG Percent Fuel Tank Pressure.

Next, at block 107, a first PG Flow Ratio is calculated by dividing the PG Percent Fuel Desired (determined in block 105) by the actual system purge flow (PG Percent Fuel Actual). In a preferred embodiment of this invention, the actual system purge flow is estimated according to the system and method described hereinbelow in connection with FIG. 5. However, one skilled in the art will recognize, in light of this disclosure, that other systems and methods could be used to determine the actual system purge flow. The result of the division is PG Flow Ratio 1, which is used in calculating the PG_FLOW_MUL reference value in block 127, as described in more detail below.

A second PG Flow Ratio is determined in blocks 109 and 111 to account for a system constraint relating to airflow through the purge valve 78. Generally, to maintain optimal idle speed control of the vehicle, it is desirable to limit the amount of air passing through the vapor recovery system into the intake manifold 56 when the total engine air mass flow rate in the intake manifold is relatively low. On the other hand, a higher amount of air can flow from the vapor recovery system into the intake manifold 56 when the total air mass flow is relatively high. Accordingly, in block 109, a maximum allowable airflow through the purge valve 78 (PG Air Max) is calculated based on idle speed airflow constraints. In particular, PG Air Max equals the current engine air mass (AM) less the product of the Bypass Air Mass and the calibratable fraction of bypass air mass. Thus, the calibratable fraction of bypass air mass is established to indicate what portion of the total engine air mass flow rate (AM) in the intake manifold should be bypass air mass. The remaining portion of the total engine air mass flow rate (AM) can come from the vapor recovery system 70.

In block 111, a PG Flow Ratio 2 is calculated by dividing the PG Air Max value (calculated in block 109) by a PG Air Actual value, which represents the actual airflow through the purge valve and, in a preferred embodiment of the invention, is estimated as described hereinafter in connection with block 511 of FIG. 5. The PG Flow Ratio 2 is used in calculating the PG_FLOW_MUL reference value in block 127, as described in more detail below.

A third PG Flow Ratio, which concerns a system constraint relating to the maximum allowable purge flow to maintain system robustness and reduce the risk of engine stalls, is determined in blocks 113 through 121. Generally, when the vehicle speed is relatively fast, a greater amount of purge flow can be employed without causing noticeable system irregularities. To the contrary, when the vehicle speed is relatively slow, a lesser amount of purge flow can be employed without causing noticeable system irregularities. Thus, a maximum purge flow percentage (PG_AM_PC_MAX) is calculated, which represents the maximum percentage of the total engine air mass flow rate (AM) that should come from the purge system. First, in block 113, a maximum purge flow percentage (PG_AM_PC_M) is determined by taking the minimum of three unitless values PG_AM_PC_MX1, PG_AM_PC_MX2, and PG_AM_PC_MX3 that are all derived from corresponding engine operating parameters relating to vehicle speed. In a preferred embodiment, the engine operating parameters are vehicle speed, engine speed, and the degree of fuel tank sloshing (determined by the rate of change of fuel tank pressure). The values for PG_AM_PC_MX1, PG_AM_PC_MX2, and PG_AM_PC_MX3 are derived from corresponding calibrated one-dimensional look-up tables. The minimum of the values corresponding to the engine operating parameters is considered the maximum purge air mass percentage (PG_AM_PC_M).

Blocks 117 through 119 relate to the particular manner in which the maximum purge air mass percentage value (PG_AM_PC_M) is changed from the previously calculated maximum purge air mass percentage. As shown in block 115, if the previous maximum purge air mass percentage (PG_AM_PC_MAX) is greater than the newly-calculated maximum purge air mass percentage (PG_AM_PC_M), then the maximum purge air mass percentage is immediately jumped down to its new value, as shown in block 115. This ensures immediate correction of the maximum air mass percentage in the event that the maximum air mass percentage decreases. On the other hand, if the previous maximum purge air mass percentage (PG_AM_PC_MAX) is less than the newly-calculated maximum purge air mass percentage (PG_AM_PC_M), then the maximum purge air mass percentage is gradually ramped upward, as shown in block 119. This is a conservative approach to modifying the maximum air mass percentage value upward to ensure that the system does not overshoot its target. The Rolav function shown in block 119 is a first order filter function with a time constant (PG_Slosh_TC) of the type that is known in the art.

Once the maximum air mass percentage value (PG_AM_PC_MAX) is determined, it is multiplied by the engine air mass flow rate (AM measured by air mass sensor 158), as shown in block 123, to determine a purge flow limit (PG Flow Limit). The purge flow limit is the maximum amount of air flow that is desirable through the vapor recovery system 70 in light of the total engine air mass flow rate in the system (AM). Finally, in block 121, PG Flow Ratio 3 is calculated by dividing the PG Flow Limit (calculated in block 123) by the PG Flow Request, which is the current amount of air mass being requested from the vapor recovery system 70 by controller 15. The PG Flow Ratio 3 is used in calculating the PG_FLOW_MUL reference value in block 127, as described in more detail below.

A fourth PG Flow Ratio is determined in block 125 that accounts for the fuel injection pulse width. Generally, when the fuel injector pulse widths are relatively small, making the fuel injectors more difficult to control, it is desirable to limit the amount of purge flow so as not to increase the amount of fuel provided from the vapor recovery system 70. In particular, the fourth PG Flow Ratio is determined from a calibrated one-dimensional look-up table using the current fuel pulse width as the index to the table. The look-up table is preferably calibrated so that the output value decreases as the commanded fuel injector pulse width decreases. In this way, the purge flow is reduced to allow the fuel injector pulse widths to increase, thus avoiding the problem of possibly degrading the fuel injector controllability. The PG Flow Ratio 4 is used in calculating the PG_FLOW_MUL reference value in block 127, as described in more detail below.

After all of the PG Flow Ratios have been determined, they are compared to each other in block 127. The various PG Flow Ratios can effectively be compared to each other because they are unitless values. The operating parameter associated with the minimum value from among all of the PG Flow Ratios is the limiting constraint of the system. The minimum PG Flow Ratio is used as the PG_FLOW_MUL reference value to adjust the purge flow.

Figure 3:
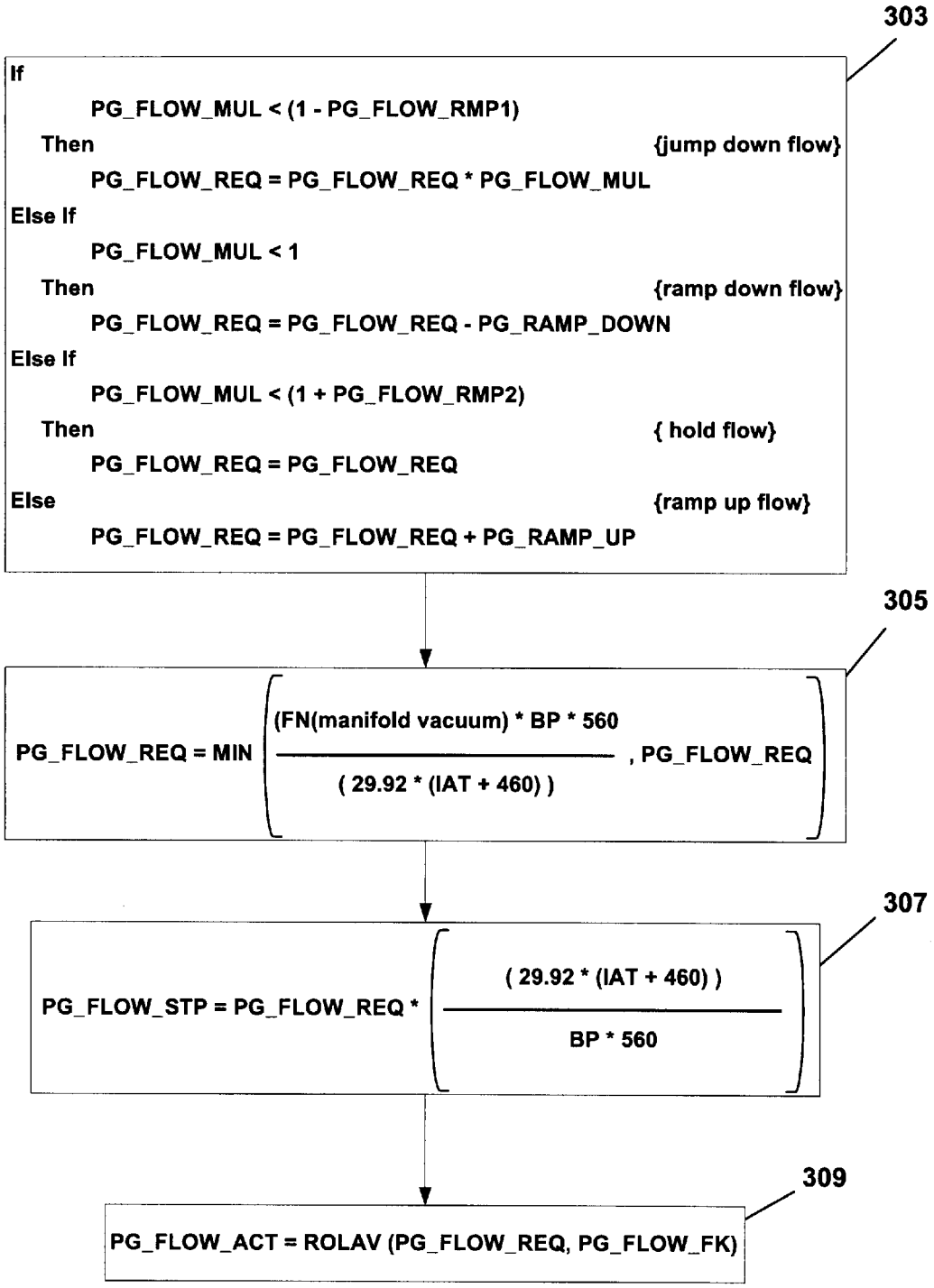
FIG. 3 is a flow chart illustrating a second aspect of a preferred embodiment of the invention relating to adjusting the system purge flow based on a unitless purge system adjustment value.

After the PG_FLOW_MUL value is determined, it is used to adjust the system purge flow as shown in FIG. 3. Specifically, the PG_FLOW_MUL value is compared to several key reference values, and then a new purge flow request value (PG_FLOW_REQ) is determined based on these comparisons. The PG_FLOW_REQ value is the desired amount of purge flow, and the controller 15 uses the PG_FLOW_REQ value to control the purge valve 76.

If the PG_FLOW_MUL value is substantially less than 1.0, then the Purge Flow Request value (PG_FLOW_REQ) is significantly decreased from its previous value. As shown in block 303, the PG_FLOW_MUL value is compared to the difference between 1.0 and a PG_FLOW_RMP1 value, where the PG_FLOW_RMP1 offsets the reference value from 1.0. If the PG_FLOW_MUL value is less than the reference value (which is significantly less than 1.0 as a result of the offset), then the Purge Flow Request value (PG_FLOW_REQ) is adjusted significantly (in a step fashion) downward by multiplying the current Purge Flow Request (PG_FLOW_REQ) value by the PG_FLOW_MUL value, which brings the Purge Flow Request value to a maximum value without violating any of the constraints.

If the PG_FLOW_MUL value is less than 1.0, but not substantially less than 1.0, then the Purge Flow Request value (PG_FLOW_REQ) is gradually reduced in a ramping fashion. The PG_FLOW_MUL value can be ramped down by either a constant or a variable increment. The downward increment employed in the preferred embodiment of the invention is signified in block 303 by PG_RAMP_DOWN, which is a pre-determined calibrated value.

If the PG_FLOW_MUL value is greater than 1.0, but only by a relatively small amount, then the current purge flow is causing the system operating conditions to be relatively close to violating one of the constraints. Thus, according to a preferred embodiment of the invention, the Purge Flow Request (PG_FLOW_REQ) value is maintained at its current level without change. As shown in block 303, the PG_FLOW_MUL value is compared to the sum of 1.0 and a PG FLOW RMP2 value, where the PG_FLOW_RMP2 value offsets the reference value from 1.0. This comparison determines whether the PG_FLOW_MUL value is greater than 1.0 by a small amount (i.e., less than PG_FLOW_RMP2) or by a more significant amount (i.e., more than PG_FLOW_RMP2). One skilled in the art will recognize that when the PG_FLOW_MUL exceeds 1.0 by a relatively small amount, it would also be possible to increase the purge flow slightly without violating any of the constraints.

Finally, if the PG_FLOW_MUL value is significantly greater than 1.0 (i.e., more than by PG_RMP2), then all of the system constraints are sufficiently satisfied such that the purge flow can be increased without significant risk that any of the constraints will be violated. In block 303, it is assumed that the PG_FLOW_MUL value is significantly greater than 1.0 if all of the previously-discussed conditions are not true. If the PG_FLOW_MUL value is significantly greater than 1.0, then the purge flow request value (PG_FLOW_REQ) is increased in a ramping fashion by adding an incremental value (PG_RAMP_UP) to the previous PG_FLOW_MUL value. The PG_RAMP_UP value may either be a constant increment or a variable increment. In a preferred embodiment of the invention, PG_RAMP_UP is a variable increment, which is calculated periodically as described below in connection with FIG. 5. Implementing a variable PG_RAMP_UP value enables the purge flow valve 78 to open more quickly under appropriate circumstances and makes the system more responsive.

Once the primary adjustment of the PG_FLOW_REQ value is accomplished as described above, the system tests the new PG_FLOW_REQ value to ensure that it is within acceptable operational range such that the PG_FLOW_REQ value does not exceed the maximum purge flow achievable by the system. Accordingly, in block 305, the PG_FLOW_REQ value is set to the minimum of the calculated PG_FLOW_REQ value and the physical maximum purge flow achievable by the system. As shown in block 305, the purge flow maximum is determined from a calibrated one-dimensional look-up table (FN) that outputs a maximum purge flow (at standard temperature and pressure) based on intake manifold vacuum. The barometric pressure (BP), the intake air temperature (IAT), and other constants are employed to convert the purge flow maximum to current operating temperature and pressure. In block 307, the PG_FLOW_REQ value is converted to a Purge Flow Request value at standard temperature and pressure (PG_FLOW_STP), which is used by the controller 15 to control the purge valve 78. One skilled in the art could find other ways to calculate the maximum possible purge flow.

Finally, in block 309, an actual amount of purge flow through the system is estimated based on the requested purge flow (PG_FLOW_REQ) and a model of the time delays and dynamics in the system. Since the actual purge flow through the system will lag the requested purge flow according to a certain time constant, it is useful to estimate the amount of actual purge flow (PG_FLOW_ACT), which is used hereinafter (FIG. 5) to estimate what percentage of the total fuel delivered to the engine cylinders comes from the vapor recovery system 70. Thus, in block 309, the actual purge flow (PG_FLOW_ACT) is estimated using a first order filter function (ROLAV) having PG_FLOW_REQ as the target value and PG_FLOW_FK as a calibrated time constant value.

Figure 4A:
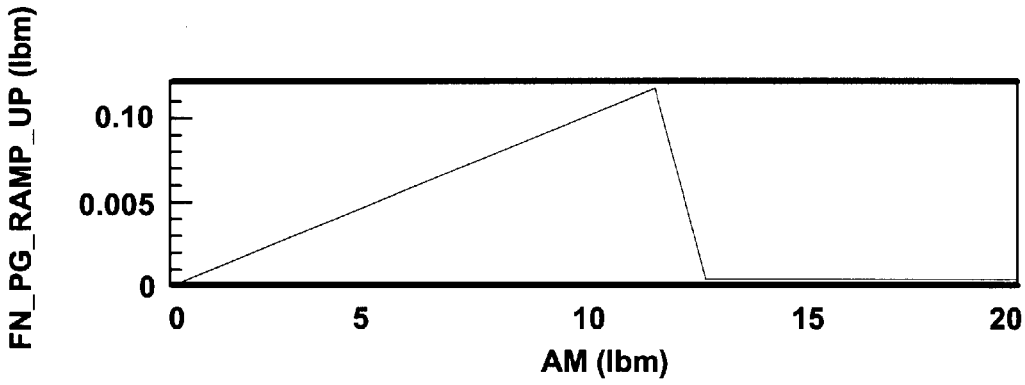
FIG. 4*a* is a graph illustrating a preferred function used to determine a base gain value component of a ramp-up increment for adjusting the system purge flow.

As indicated above, the preferred embodiment of the invention adjusts the purge flow upward, when appropriate, according to a variable increment value PG_RAMP_UP. The PG_RAMP_UP increment value is determined according to the following equation:

PG_RAMP_UP=FN_PG_RAMP_UP(AM)*FN _PG_RAMP(PG_FLOW_REQ)

where FN_PG_RAMP_UP is a calibrated one-dimensional look-up table that returns a base gain value dependant on engine air mass flow rate (AM), and FN_PG_RAMP is a calibrated one-dimensional look-up table that returns a base ramp value dependant on the current requested purge flow (PG_FLOW_REQ). FIG. 4*a* sets forth a graphical representation of a function that defines a preferred FN_PG_RAMP_UP look-up table. Specifically, at relatively low and mid-range levels of engine air mass flow rate (AM) (less than about 12 lbm.), the inventors have determined that the rate of increasing the purge flow should be linearly increased from 0 to about 0.10. With an air mass (AM) value above approximately 12 lbm., the PG_RAMP_UP value is preferably about zero. The FN_PG_RAMP_UP value allows the increment of purge flow increase to be adjusted based on engine air mass (AM).

Figure 4B:
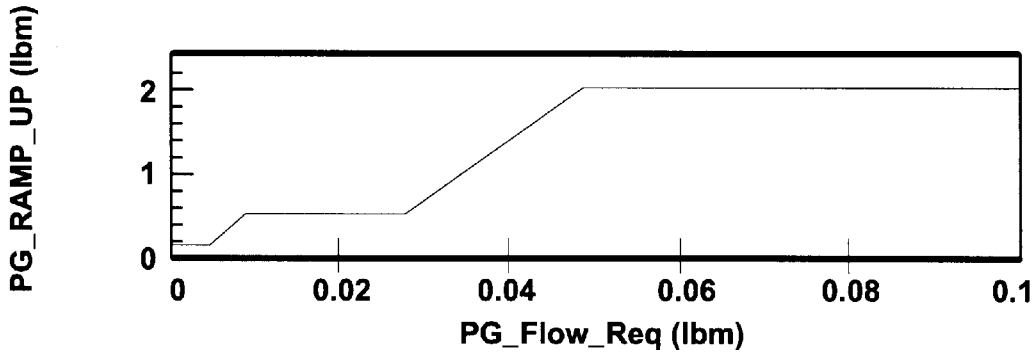
FIG. 4*b* is a graph illustrating a preferred function used to determine a base ramp value component of a ramp-up increment for adjusting the system purge flow.

The base gain value returned by the FN_PG_RAMP_UP look-up table is multiplied by a base ramp value, which is determined from the FN_PG_RAMP look-up table based on the current Requested Purge Flow (PG_FLOW_REQ). Preferably, the FN_PG_RAMP table returns larger values when the PG_FLOW_REQ value is relatively high and smaller values when the PG_FLOW_REQ value is relatively low. FIG. 4*b* sets forth a graphical representation of a function that defines a preferred FN_PG_RAMP look-up table. Essentially, this methodology causes the system to ramp up the purge flow more quickly when the vapor recovery system 70 is already flowing a relatively large amount and more slowly when the vapor recovery system is currently flowing a lesser amount. This is desirable because there is a higher degree of uncertainty as to the total amount of fuel that is delivered at lower purge flow rates.

Figure 5:
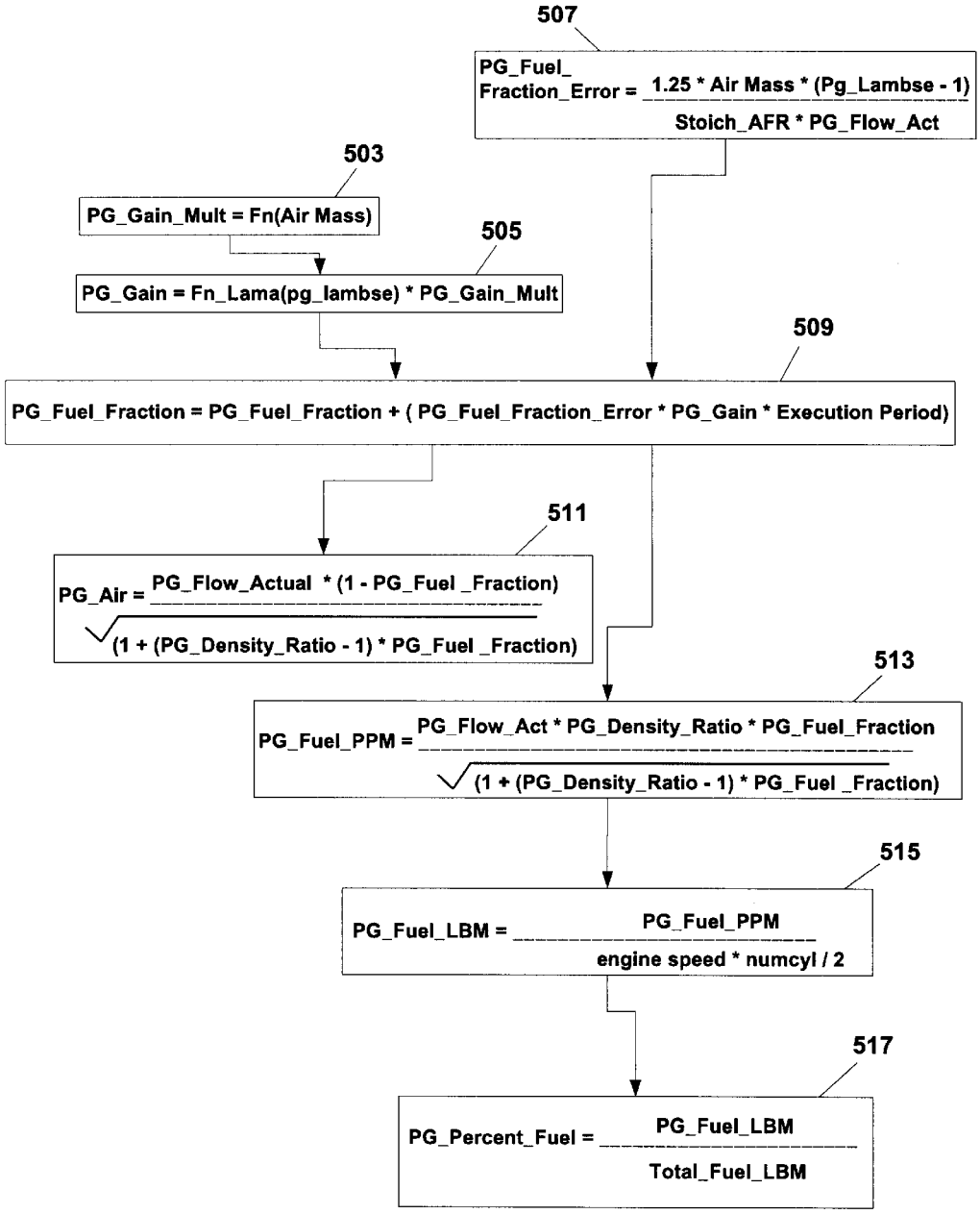
FIG. 5 is a flow chart illustrating a third aspect of a preferred embodiment of the invention relating to determining a portion of the total amount of fuel delivered to the engine coming from the purge system.

Now, with reference to FIG. 5, the aspect of the invention for determining what portion of the total fuel delivered to the engine cylinders comes from the vapor recovery system is described. A feature of the system and method set forth in FIG. 5 is to proactively predict the amount of fuel that is delivered to the engine cylinders from the vapor recovery system, as opposed to known prior art systems wherein the amount of fuel delivered from the vapor recovery system had to be reactively "learned" each time the purge valve 78 was adjusted. Blocks 503 through 509 of FIG. 5 relate generally to steps for determining a Purge Fuel Fraction (PG_FUEL_FRACTION), which represents the proportion of fuel vapor relative to total purge flow, including air, that passes through the purge valve 78. Once the PG_FUEL_FRACTION is determined, it is used to determine what portion of the total amount of fuel delivered to the engine cylinders comes from the vapor recovery system (PG_PERCENT_FUEL), as shown in blocks 513 through 517.

Blocks 503 and 505 illustrate calculating an integral gain based on current engine conditions, i.e., engine air mass flow rate (AM) and feedback from exhaust oxygen sensors 53 and 54. In particular, in block 503, a Purge Gain Multiplier value (PG_GAIN_MULT) is determined from a one-dimensional look-up table (FN) dependant on the engine air mass flow rate (AM), which is measured by sensor 158. In block 505, the PG_GAIN_MULT value is multiplied by the output of another one-dimensional look-up table, FN_LAMA, which is dependant on a variable, PG_LAMBSE. The PG_LAMBSE variable is an engine air/fuel ratio feedback correction parameter that can be calculated according to a variety of known methods based on the outputs of exhaust gas sensors 53 and 54.

In block 507, a Purge Fuel Fraction Error term (PG_FUEL_FRACTION_ERROR) is calculated according to the formula set forth therein, where "Stoich_AFR" is the engine air/fuel ratio at stoichiometry and the PG_FLOW_ACT variable is the estimated actual purge flow through the purge valve 78, as calculated in block 309 of FIG. 3. As described above, PG_LAMBSE is an engine air/fuel ratio feedback correction parameter calculated based on the outputs of exhaust oxygen sensors 53 and 54. Thus, based on the degree of correction necessary for the engine air/fuel ratio, the system determines the degree of error in the current estimated purge fuel fraction (PG_FUEL_FRACTION) value, as shown in block 507.

In block 509, a new Purge Fuel Fraction (PG_FUEL_FRACTION) is calculated based on the previous Purge Fuel Fraction, the purge gain (PG_GAIN), and the purge fuel fraction error (PG_FUEL_FRACTION_ERROR). Specifically, the previous PG_FUEL_FRACTION value is modified to correct for the purge fuel fraction error calculated in block 507. The PG_FUEL_FRACTION_ERROR value is multiplied by the PG_GAIN value (from block 505) and a time period or delta time, which represents a time constant since a previous time when the PG_FUEL_FRACTION value was updated. One skilled in the art, in view of this disclosure, will recognize that the portion of the invention set forth in block 509 is an integration function that adjusts the purge fuel fraction based on the magnitude of the fuel fraction error. Further, one skilled in the art will recognize that the integrator in block 509 could be employed without the variable PG_GAIN value. However, the inventors hereof have discovered that the system can be made more responsive, particularly with respect to relatively large fuel fraction errors, by including the PG_GAIN value variable and allowing it to vary with the PG_LAMSE value.

Once the PG_FUEL_FRACTION value is determined, it is used to calculate the amount of purge air (PG_AIR) and purge fuel (PG_FUEL_PPM) passing through the purge valve 78. In block 511, the purge air (PG_AIR) is calculated according to the formula set forth therein. The numerator of the formula simply multiplies the total actual purge flow (air and fuel), as estimated in block 309 of FIG. 3, by the difference of 1.0 minus the PG_FUEL_FRACTION. The denominator of the formula constitutes a known expression to account for the difference in density between air and fuel. The PG_AIR value is used in block 111 of FIG. 2 to contribute to the adjustment of the purge valve 78.

In block 513, the amount of purge fuel passing through the purge valve 78 in terms of pounds per minute (PG_FUEL_PPM) is calculated according to the formula set forth therein. The actual purge flow (PG_FLOW_ACT), which is estimated in block 309 of FIG. 3, is multiplied by a purge density ratio (PG_DENSITY_RATIO) and the purge fuel fraction (PG_FUEL_FRACTION) calculated in block 509.

The PG_DENSITY_RATIO value is a calibrated value based on the density of fuel vapor to air. As above, the denominator of the formula constitutes a known expression to account for the difference in density between air and fuel.

In block 515, the PG_FUEL_PPM value, which is in units of pounds per minute, is converted to a purge fuel amount in terms of pounds per cycle by each of the engine fuel injectors (PG_FUEL_LBM). As set forth in block 515, the PG_FUEL_LBM value is calculated by dividing the PG_FUEL_PPM value by the engine speed (RPM) and half of the number of cycles (NUMCYL).

Finally, in block 517, the percent of fuel delivered to the engine cylinders that is attributable to the purge system (PG_PERCENT_FUEL) is determined. Specifically, the PG_FUEL_LBM (from block 515) is divided by the Total_Fuel_LBM per cycle for each cylinder injected into the engine cylinders. Then, the PG_PERCENT_FUEL value is used in block 107 of FIG. 2 to adjust the target purge fuel amount to be delivered to the engine cylinders, and thus adjust the purge valve 78.

What is claimed is:

1. A method of controlling fuel vapor release from a vapor recovery system into an intake manifold of an internal combustion engine, comprising the steps:

determining a first purge flow ratio that is indicative of a desired amount of fuel vapor to be released from the vapor recovery system relative to an actual amount of fuel vapor released from the vapor recovery system;

determining at least one second purge flow ratio that is indicative of a maximum desired value of an operating parameter relative to an actual value of said operating parameter; and adjusting the amount of fuel vapor released from the vapor recovery system based on said first purge flow ratio and said second purge flow ratio.

2. The method of claim 1, further comprising the step of determining a minimum purge flow ratio from among said first purge flow ratio and said second purge flow ratio; and adjusting said amount of fuel vapor released from the vapor recovery system based on said minimum purge flow ratio.

3. The method of claim 2, wherein said fuel vapor adjustment step comprises decreasing a requested purge flow parameter, which is indicative of a target amount of fuel vapor to release from the vapor recovery system, when said minimum purge flow ratio is less than a reference value.

4. The method of claim 3, wherein said reference value is 1.0.

5. The method of claim 3, wherein said requested purge flow parameter is decreased abruptly when said minimum purge flow ratio is substantially less than said reference value and said requested purge flow parameter is decreased gradually when said minimum purge flow ratio is slightly less than said reference value.

6. The method of claim 3, wherein said fuel vapor adjustment step further comprises maintaining said requested purge flow parameter when said minimum purge flow ratio is greater than said reference value, but not substantially greater than said reference value.

7. The method of claim 6, wherein said fuel vapor adjustment step further comprises increasing said requested purge flow parameter when said minimum purge flow ratio is substantially greater than said reference value.

8. The method of claim 7, wherein said requested purge flow parameter is increased by a variable ramp up value.

9. The method of claim 8, wherein said variable ramp up value is determined based on a parameter indicative of engine air mass.

10. The method of claim 9, wherein said variable ramp up value is further determined based on said requested purge flow parameter.

11. The method of claim 7, wherein said fuel vapor adjustment step further comprises limiting said purge flow parameter to a value that is within operational capabilities of the vapor recovery system.

12. The method of claim 1, wherein said desired amount of fuel vapor to be released from the vapor recovery system is determined based on at least one engine operating condition.

13. The method of claim 12, wherein said at least one engine operating condition is throttle position.

14. The method of claim 12, wherein said desired amount of fuel vapor to be released from the vapor recovery system is further determined based on a rate of change of fuel tank pressure.

15. The method of claim 1, wherein said maximum desired value of an operating parameter is determined based on engine air mass flow rate.

16. The method of claim 1, wherein said maximum desired value of an operating parameter is determined based on vehicle speed.

17. The method of claim 16, wherein said maximum desired value of an operating parameter is adjusted downward when said vehicle speed is below a reference value; and said maximum desired value of an operating parameter is adjusted upward when said vehicle speed is greater than said reference value.

18. The method of claim 1, wherein said maximum desired value of an operating parameter is determined based on fuel injector pulse width.

19. The method of claim 1, wherein said maximum desired value of an operating parameter is determined based on engine speed.

20. The method of claim 1, wherein said maximum desired value of an operating parameter is determined based on idle air mass flow.

21. A fuel vapor recovery system coupled to an internal combustion engine, comprising:

a fuel vapor absorbent coupled between a fuel tank and the engine;

a purge valve coupled between said fuel vapor absorbent and the engine for controlling release of fuel vapor from said absorbent into the engine; and a controller for determining a first purge flow ratio that is indicative of a desired amount of fuel vapor to be released from the vapor recovery system relative to an actual amount of fuel vapor released from the vapor recovery system; determining at least one second purge flow ratio that is indicative of a maximum desired value of an operating parameter relative to an actual value of said operating parameter; and adjusting an amount of fuel vapor released from the vapor recovery system based on said first purge flow ratio and said second purge flow ratio.

22. The system of claim 21, wherein said controller further determines a minimum of said first purge flow ratio and said second purge flow ratio; and said controller adjusts said amount of fuel vapor released from the vapor recovery system based on said minimum purge flow ratio.

23. The system of claim 22, wherein said controller further determines an amount of fuel vapor to be released from the vapor recovery system based on at least one engine operating condition.

24. The system of claim 23, wherein said at least one engine operating condition is throttle position.

25. The system of claim 24, wherein said controller further determines said desired amount of fuel vapor to be released from the vapor recovery system based on a rate of change of fuel tank pressure.

26. The system of claim 21, wherein said controller determines said maximum desired value of an operating parameter based on engine air mass flow rate in the engine.

27. The system of claim 21, wherein said controller determines said maximum desired value of am operating parameter based on vehicle speed.

28. The system of claim 27, wherein said controller adjusts said operating parameter maximum downward when said vehicle speed is below a reference value and said controller adjusts said operating parameter maximum upward when said vehicle speed is greater than said reference value.

29. The method of claim 21, wherein said controller determines said maximum desired value of an operating parameter based on fuel injector pulse width.

30. The method of claim 21, wherein said controller determines said maximum desired value of an operating parameter based on idle air mass flow.

31. The system of claim 22, wherein said controller decreases a requested purge flow parameter, which is indicative of a target amount of fuel vapor to release from the vapor recovery system, when said minimum purge flow ratio is less than a reference value.

32. The system of claim 31, wherein said controller decreases said requested purge flow parameter abruptly when said minimum purge flow ratio is substantially less than said reference value and said controller decreases said requested purge flow parameter gradually when said minimum purge flow ratio is slightly less than said reference value.

33. The method of claim 22, wherein said controller maintains said requested purge flow parameter when said minimum purge flow ratio is greater than said reference value, but not substantially greater than said reference value.

34. The method of claim 33, wherein said controller increases said requested purge flow parameter when said minimum purge flow ratio is substantially greater than said reference value.

35. A method of controlling fuel vapor release from a vapor recovery system into an intake manifold of an internal combustion engine, comprising the steps:

determining a first purge flow ratio that is indicative of a desired amount of fuel vapor to be released from the vapor recovery system relative to an actual amount of fuel vapor released from the vapor recovery system;

determining at least one second purge flow ratio that is indicative of a maximum desired value of an operating parameter relative to an actual value of said operating parameter;

determining a minimum purge flow ratio from among said first purge flow ratio and said second purge flow ratio;

decreasing a requested purge flow parameter, which is indicative of a target amount of fuel vapor to release from the vapor recovery system, when said minimum purge flow ratio is less than a reference value; and increasing said requested purge flow parameter when said minimum purge flow ratio is greater than said reference value.

36. A method for controlling an amount of fuel vapor released from a vapor recovery system to an intake manifold of an engine, the method comprising:

determining a first vapor flow control value based on both a desired amount of fuel vapor to be released from said vapor recovery system and an actual amount of fuel vapor being released from the system;

determining a second vapor flow control value based on both a desired value of an engine operating parameter and an actual value of said engine operating parameter; and, adjusting the amount of fuel vapor released from the vapor recovery system based on the first vapor flow control value and the second vapor flow control value.

* * * * *